US010907920B2

(12) United States Patent
Walker

(10) Patent No.: US 10,907,920 B2
(45) Date of Patent: Feb. 2, 2021

(54) SOUND SUPPRESSOR FOR A FIREARM

(71) Applicant: Incodema3D, LLC, Ithaca, NY (US)

(72) Inventor: Drew Walker, Mesa, AZ (US)

(73) Assignee: Incodema3D, LLC, Ithaca, NY (US)

( * ) Notice: Subject to any disclaimer, the term of this patent is extended or adjusted under 35 U.S.C. 154(b) by 215 days.

(21) Appl. No.: 16/102,937

(22) Filed: Aug. 14, 2018

(65) Prior Publication Data

US 2019/0063860 A1 Feb. 28, 2019

Related U.S. Application Data

(60) Provisional application No. 62/548,759, filed on Aug. 22, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223
See application file for complete search history.

(56) References Cited

U.S. PATENT DOCUMENTS 2,375,617 A * 5/1945 Bourne ..... F41A 21/30 181/223
2,514,996 A * 7/1950 Faust, Jr. ..... F41A 21/34 181/223
3,748,956 A * 7/1973 Hubner ..... F41A 21/30 89/14.4
8,567,556 B2 10/2013 Dueck
8,939,057 B1 * 1/2015 Edsall ..... F41A 21/30 181/223
8,967,325 B1 3/2015 Cronhelm
D728,058 S * 4/2015 Cheney ..... D22/108
D741,443 S * 10/2015 Cheney ..... F41A 21/30 D22/108
10,126,084 B1 * 11/2018 Oglesby ..... F41A 21/30
(Continued)

FOREIGN PATENT DOCUMENTS

RU 2437048 C1 12/2011

OTHER PUBLICATIONS

Wikipedia p. For Selective Laser Melting; Mar. 22, 2015; <https://web.archive.org/web/20150322225816/https://en.wikipedia.org/wiki/Selective laser melting>.*

(Continued)

*Primary Examiner* — Jeremy A Luks
(74) *Attorney, Agent, or Firm* — Alliance IP, LLC

(57) ABSTRACT

A suppressor for a firearm is disclosed. The suppressor may have a hollow elongated body extending from a proximal end to a distal end. The suppressor may also have an expansion chamber disposed within the body. The expansion chamber may extend from adjacent the proximal end to a position between the proximal and distal ends. The suppressor may have a first plurality of vanes disposed in the expansion chamber. The first vanes may be laterally spaced apart from each other along a periphery of the body. The suppressor may further have a second plurality of vanes disposed in the body. The second plurality of vanes may be axially spaced apart from the first vanes. The tips of the first and second plurality of vanes may define a generally cylindrical passageway disposed coaxially with the body.

18 Claims, 9 Drawing Sheets

(56) References Cited

U.S. PATENT DOCUMENTS

| | | | | |
|---|---|---|---|---|
| 10,184,743 | B2 * | 1/2019 | Lau | F41A 21/30 |
| 10,458,739 | B2 * | 10/2019 | Smith | F41A 21/30 |
| 10,480,885 | B2 * | 11/2019 | Mohler | F41A 21/30 |
| 2012/0180624 | A1 * | 7/2012 | Troy | F41A 21/30 89/14.4 |
| 2015/0338183 | A1 * | 11/2015 | Salvador | F41A 21/30 181/223 |
| 2015/0338184 | A1 * | 11/2015 | White | F41A 21/30 89/14.4 |
| 2017/0225227 | A1 * | 8/2017 | Volk | B33Y 30/00 |
| 2017/0299291 | A1 | 10/2017 | Spector | |
| 2018/0164065 | A1 | 6/2018 | Mohler | |
| 2018/0347932 | A1 * | 12/2018 | Bray | F41A 21/34 |
| 2018/0356173 | A1 * | 12/2018 | Dorne | F41A 21/28 |
| 2019/0041154 | A1 * | 2/2019 | Cheinet | F41A 21/30 |

OTHER PUBLICATIONS

DefenceTalk, Thermal Cloak Prevents Weapon Detection by Thermal Imagers, (Jan. 26, 2015), 3 pages at https://www.defencetalk.com/thermal-cloak-preventsweapon-detection-by-thermal-imagers-62182/.

* cited by examiner

SOUND SUPPRESSOR FOR A FIREARM

CROSS-REFERENCE TO RELATED APPLICATION

This application is based on and claims benefit of priority of U.S. Provisional Patent Application No. 62/548,759, filed Aug. 22, 2017, which is incorporated herein by reference in its entirety.

TECHNICAL FIELD

The present disclosure relates generally to a sound suppressor for a firearm, and more particularly, to a sound suppressor having specialized internal structures that may be made using additive manufacturing.

BACKGROUND

A firearm, for example, pistol, rifle, or any other type of gun, typically produces a sound when the firearm is discharged. When the firearm is discharged, propellant in a projectile (e.g. bullet) combusts, producing combustion gases. The combustion gases are ejected from the projectile at a high velocity, propelling the projectile through and out of the firearm in an opposite direction. The sound generated by the firearm is typically attributed to three sources: muzzle blast, sonic boom, and mechanical noise. Muzzle blast is caused by the high temperature and high pressure combustion gases escaping from the firearm after the projectile has exited the firearm. A sonic boom is generated because of shock waves created by the projectile as well as the escaping gas, when it travels at a speed exceeding the speed of sound. The mechanical noise is generated because of the interaction and relative movement of various components of the firearm.

It is desirable to reduce and/or eliminate the sound produced by a discharging firearm for a variety of reasons. These may include, for example, the desire for stealth during hunting or military operations, or for hearing protection for anyone in the vicinity of the firearm. In particular, it may be desirable to reduce and/or eliminate the sound produced by a discharging firearm to minimize health risks (e.g. hearing loss) to frequent shooters.

Sound suppressors, also known as silencers, are often used to reduce the sound generated by the muzzle blast. Suppressors typically include a generally hollow cylinder mounted at the muzzle of the barrel of a firearm. The projectile passes from the muzzle of the firearm into and through the suppressor. Prior art suppressors include a series of baffles and/or chambers to decelerate, decompress, and absorb some of the combustion gasses that follow the projectile from the muzzle. This general approach to suppressing firearms has been in practice for nearly a century, and is even considered by some to be "modern". That said, it is significant to note that suppression of a firearm's muzzle blast is a matter of both acoustics as well as fluid dynamics. After the projectile has exited the suppressor, the combustion gases trapped by the baffles and/or expansion chambers can exit the suppressor at lower velocities, thereby reducing the generated sound somewhat. Sound, by its nature, still passes through the physical walls of the suppressor and exits the suppressor while still producing audible sound, albeit subdued to a relative degree. These traditional baffle and expansion chamber design leave much to be desired and deal more with gas velocity as opposed to strictly acoustics.

"Modern" sound suppressors, have limited efficacy and have relied on virtually the same means of suppression—baffles and chambers. Shockingly, the baffle and chamber way of suppressing a firearm only addresses one aspect of the noise generated from a gunshot—this method only slows down the gunshot's gases. The goal in suppressing a gunshot is to muffle all sound. Gases flowing through a suppressor are, by their nature, supersonic, compressible, and unsteady. The projectile may or may not be subsonic but the gases themselves, if left to strike the ambient air without a suppressor present, would expand and exhibit their own shockwave. "Modern" sound suppressors provide a way of slowing down these gases, but the gases themselves don't deliver the audible "boom"; rather, they only produce the shockwave due to their speed. Therefore, while the gases do need to decelerate rapidly, the shockwave still needs to be dampened. Traditional suppressors slow gases down but still allow the shockwave to pass through the medium of the suppressor itself.

Typical manufacturing methods, for example, casting and/or machining, can produce only a small range of internal architectures while also requiring welding and/or permanent sealing of an assembly of parts, which in turn may affect longevity and structural integrity of the suppressor. Even when traditional manufacturing methods are capable of physically creating certain internal architectures, they are cost prohibitive and are therefore do not lend themselves to the engineering required to successfully suppress a firearm in an ideal manner, as this requires the application of fluid dynamics as well as acoustics. Furthermore, these traditional baffle and expansion chamber designs create an increase in backpressure (the shooter experiences an unpleasant blowback effect), and during successive, rapid firing, these traditional suppressors create a mirage effect vertically above the suppressor itself due to the heat rising off of it, thereby limited the viable choice of materials and coatings. As a result, current-day suppressors provide limited suppression capability while also causing some undesirable side effects, as mentioned above. Actual firearm reports can still be still loud enough, even after suppression, to present health risks to frequent shooters. Therefore, not only does the ideal suppressor need to be as hearing-safe as possible, it also needs to limit the additional drawbacks experienced when using traditional, present-day suppressors.

The suppressor of the present disclosure addresses one or more of the problems set forth above and/or other problems of the prior art.

SUMMARY

In one aspect, the present disclosure is directed to a suppressor for a firearm. The suppressor may include a hollow elongated body extending from a proximal end to a distal end. The suppressor may also include an expansion chamber disposed within the body. The expansion chamber may extend from adjacent the proximal end to a position between the proximal and distal ends. The suppressor may include a first plurality of vanes disposed in the expansion chamber. The first vanes may be laterally spaced apart from each other along a periphery of the body. The suppressor may further include a second plurality of vanes disposed in the body. The second plurality of vanes may be axially spaced apart from the first vanes. The tips of the first and second plurality of vanes may define a generally cylindrical passageway disposed coaxially with the body.

In another aspect, the present disclosure is directed to a method of manufacturing a suppressor for a firearm. The method may include an additive manufacturing technique that may produce a unitary monolithic suppressor including a hollow elongated body extending from a proximal end to a distal end. Additive manufacturing may provide the ability to combine many exotic features that would be difficult to combine, both internally and externally, into a unitary object, providing superb strength and structural integrity. The unitary monolithic suppressor may also include an expansion chamber extending from adjacent the proximal end to a position between the proximal and distal ends. The unitary monolithic suppressor may include a first plurality of vanes disposed in the expansion chamber. The first vanes may be laterally spaced apart from each other along a periphery of the body. The second plurality of vanes may be axially spaced apart from the first vanes. The tips of the first and second plurality of vanes may define a generally cylindrical passageway disposed coaxially with the body. The unitary monolithic suppressor may also have porous baffle-like structures comprising of mesh-like patterns. These structures may be in series and coaxial to said vanes. The mesh structures, along with the plurality of vanes, serve to slow down the gases produced by a gunshot by way of changing their vector, introducing friction to the gas flow, and providing ample surface area for heat transfer to occur. In yet another aspect of the invention, an additive manufacturing technique may be used to create double-wall vacuum or sealed chambers substantially surrounding the suppressor's outer anatomy so as to create a medium for which sound would have difficulty passing through.

DETAILED DESCRIPTION

Figure 1:
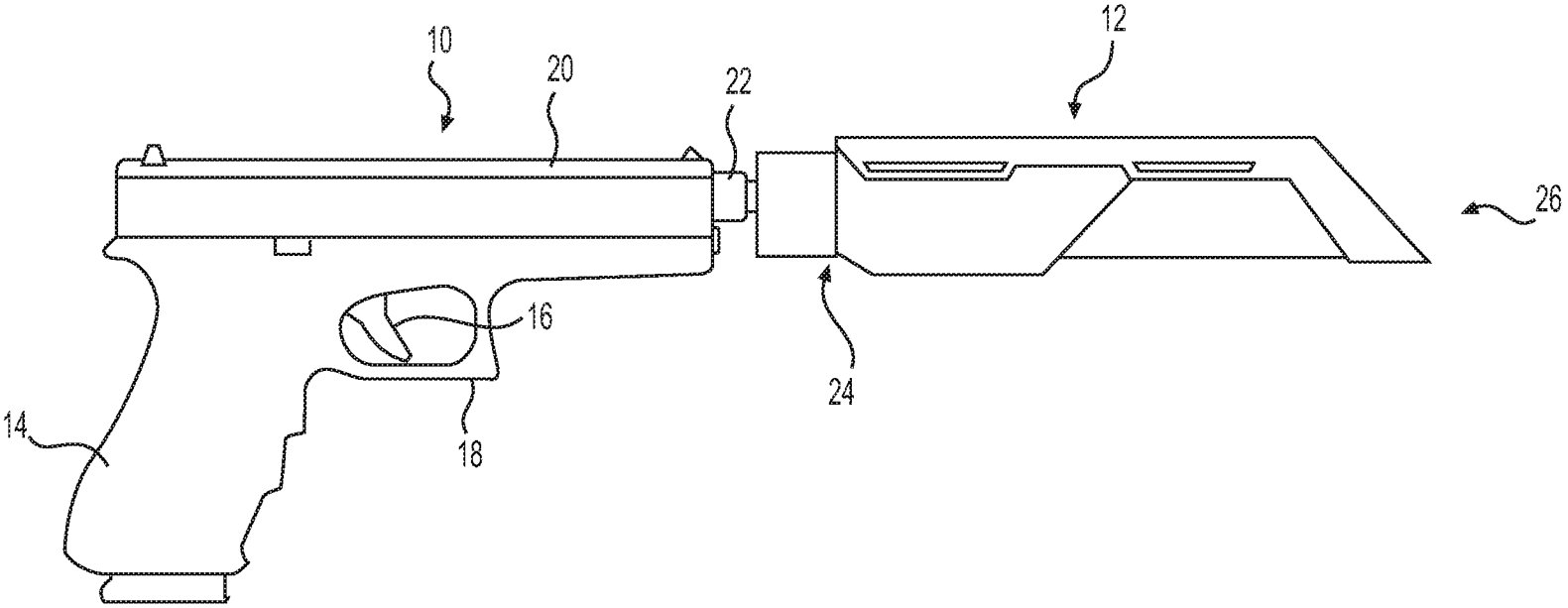
FIG. 1 is an illustration of an exemplary firearm and suppressor.

FIG. 1 illustrates an exemplary firearm 10 with suppressor 12. As illustrated in FIG. 1, firearm 10 may be a pistol. It is contemplated, however, that firearm 10 may be a rifle, handgun, and/or any other type of firearm known in the art. Firearm 10 may include grip 14, trigger 16, trigger guard 18, barrel 20, and muzzle 22. One or more projectiles (not shown) may exit barrel 20 via muzzle 22 when firearm 10 is discharged. As also illustrated in FIG. 1, suppressor 12 may extend from proximal end 24 to distal end 26. Suppressor 12 may be connected to muzzle 22 of firearm 10 adjacent proximal end 24. In operation, projectiles exiting muzzle 22 of firearm 10 may enter suppressor 12 adjacent proximal end 24, travel through a passageway (not shown) in suppressor 12, and exit from suppressor 12 at distal end 26.

Figure 2:
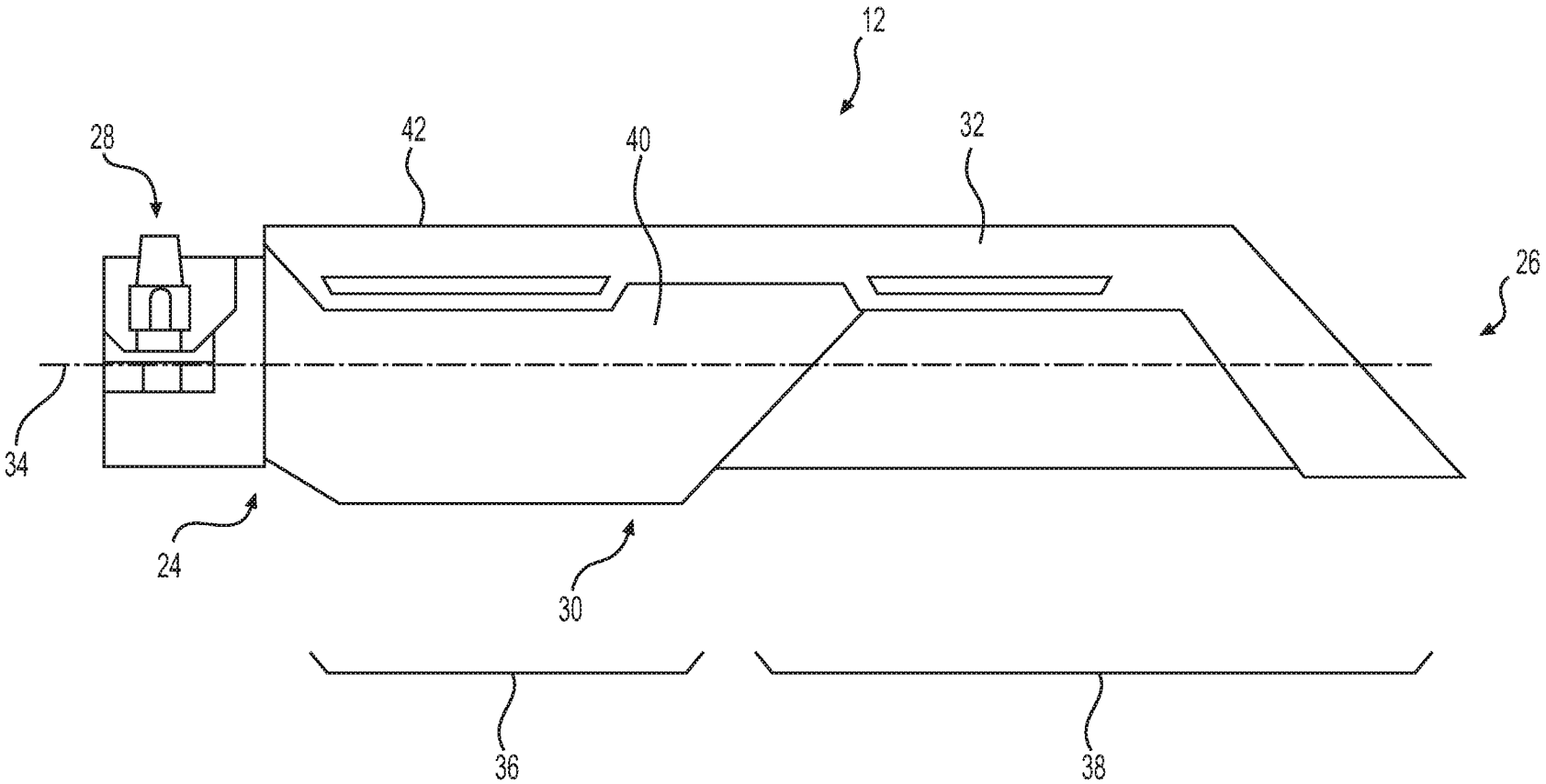
FIG. 2 is an illustration of the exemplary disclosed suppressor of FIG. 1.

FIG. 2 illustrates a pictorial view of an exemplary suppressor 12. As illustrated in FIG. 2, suppressor 12 may include attachment portion 28, body 30, and heat shield 32. Attachment portion 28 may be fixedly or removably attached to body 30 at proximal end 24. Attachment portion 28 may be configured to allow body 30 of suppressor 12 to be attached to muzzle 22 of firearm 10. In some exemplary embodiments, attachment portion 28 may include threads, which may be configured to mate with threads on or in muzzle 22. In other exemplary embodiments, attachment portion 28 may include a quick-disconnect clamp or other coupling mechanism to removably attach body 30 of suppressor 12 to muzzle 22. Additionally, in other exemplary embodiments, attachment portion 28 may be physically fused to, and therefore integral with, the muzzle 22.

Body 30 of suppressor 12 may be elongated, and may extend from proximal end 24 to distal end 26. Body 30 may be disposed about a longitudinal axis 34. Body 30 may include blast chamber portion 36 and gas decompression portion 38. Blast chamber portion 36 may extend from proximal end 24 to a position between proximal end 24 and distal end 26. Blast chamber portion 36 may be configured to decrease the noise generated due to discharge of firearm 10 by allowing combustion gases entering suppressor 12 to expand and decelerate significantly before entering gas decompression portion 38. Gas decompression portion 38 may extend from blast chamber portion 36 to distal end 26 of body 30. In some exemplary embodiments, front face of suppressor 12, adjacent distal end 26 may be slanted relative to longitudinal axis 34. In other exemplary embodiments, front face of suppressor 12, adjacent distal end 26 may be disposed generally perpendicular to longitudinal axis 34.

Heat shield 32 may be mounted on body 30 of suppressor 12. Heat shield 32 may be configured to insulate outer surface 40 of body 30. In one exemplary embodiment as illustrated in FIG. 2, heat shield 32 may cover only a portion of outer surface 40. It is contemplated, however, that heat shield 32 may cover some or all of outer surface 40 of body 30. Heat shield 32 may prevent at least some heat generated within suppressor 12 from travelling to outer surface 42 of heat shield 32, providing a relatively cooler outer surface 42, which may be used to handle suppressor 12 during assembly or disassembly of suppressor 12 to firearm 10 or lessening the mirage effect (which may affect target acquisition) above a suppressor generated by rising heat due to firing. Heat shield 32 may provide additional structural rigidity and break up possible vibrations from a resonant frequency.

Figure 3:
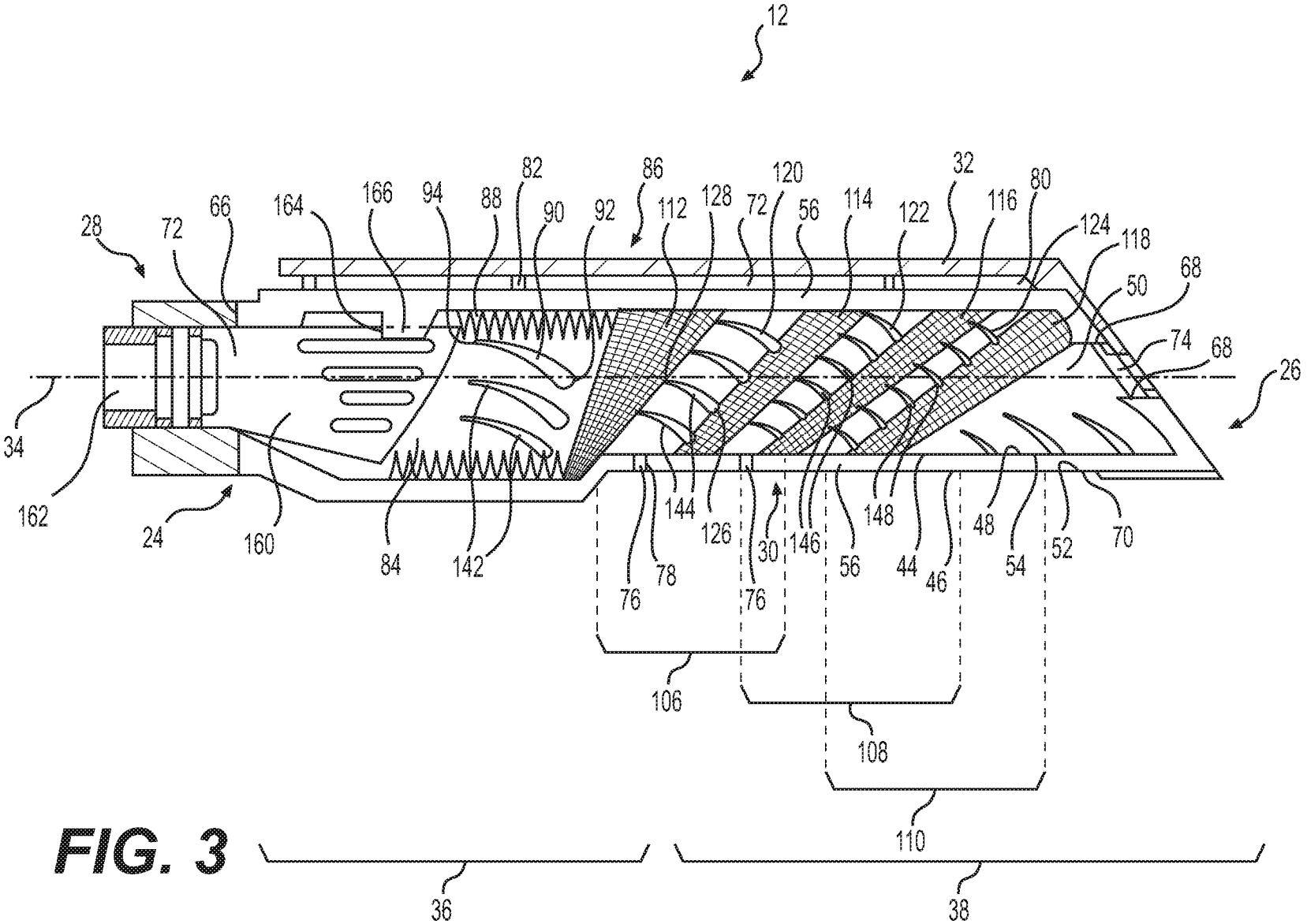
FIG. 3 is a cross-sectional view of the exemplary disclosed suppressor of FIG. 2.

FIG. 3 illustrates a cross-sectional view of suppressor 12 in a plane passing through longitudinal axis 34. As illustrated in FIG. 3, body 30 may be hollow and may include inner casing 44 and outer casing 46. Inner casing 44 may extend from adjacent proximal end 24 to adjacent distal end 26. Inner casing 44 may be hollow and may have inner surface 48, which may define hollow space 50. Outer casing 46 may also extend from adjacent proximal end 24 to distal end 26. Like inner casing 44, outer casing 46 may also be hollow. Inner casing 44 may be disposed within outer casing 46. At least some portion of inner surface 52 of outer casing 46 may be spaced apart (i.e. separated) from outer surface 54 of inner casing 44 by gap 56. In some exemplary embodiments, body 30 may include two separate portions aligned adjacent to each other along longitudinal axis 34. The two separate portions may be separated by a baffle. Gap 56 may be disposed within an interior of the baffle.

Figure 4:
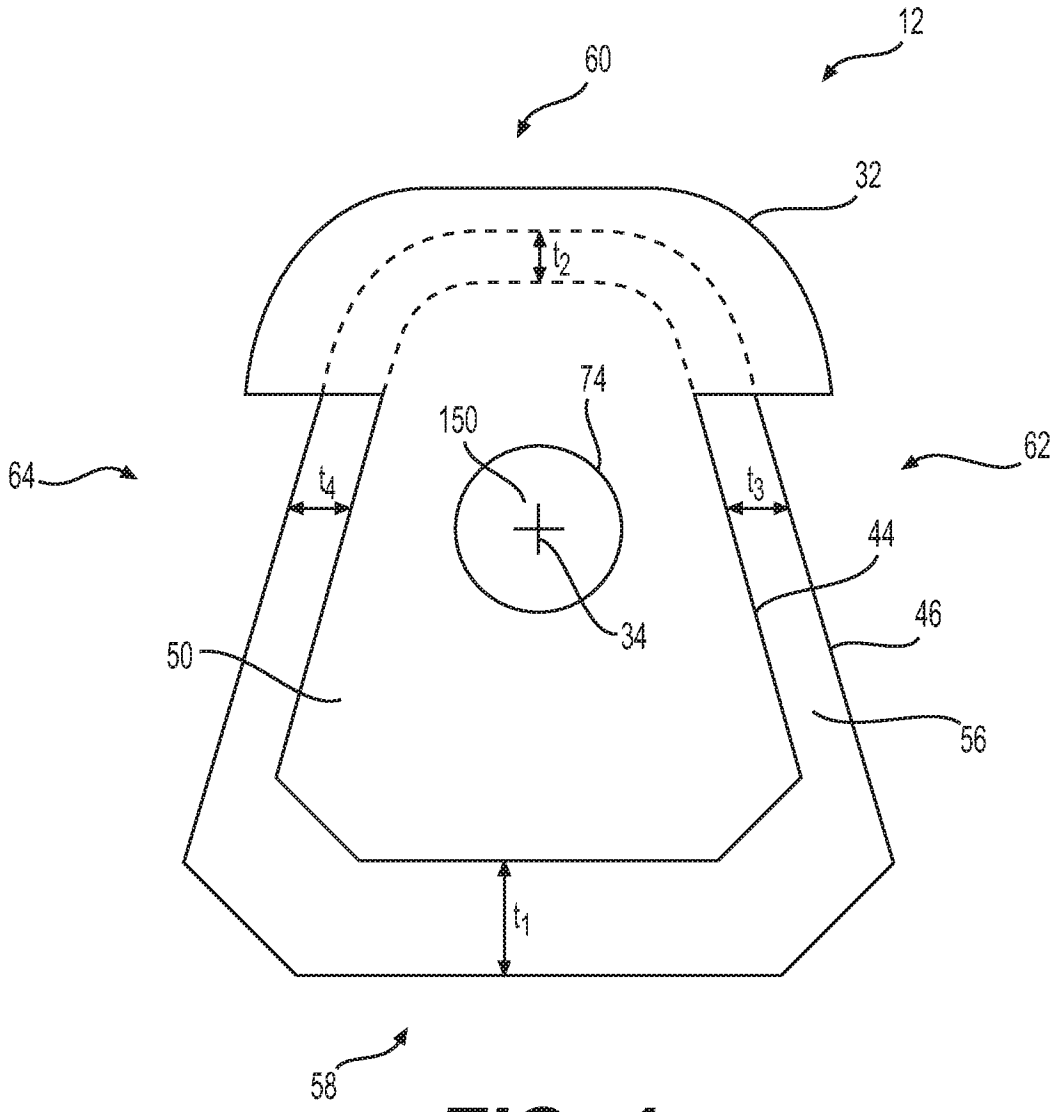
FIG. 4 is a front view of the exemplary disclosed suppressor of FIG. 2.

FIG. 4 illustrates a front view of suppressor 12 as viewed from distal end 26 looking towards proximal end 24. As illustrated in FIG. 4, body 30 of suppressor 12 may have a generally trapezoidal shape. It is contemplated, however, that body 30 of suppressor 12 may have a cylindrical shape or any other shape known in the art. Gap 56 may be disposed over an entire periphery of inner and outer casings 44 and 46. Gap 56 may have a uniform thickness or a non-uniform thickness along the periphery of inner and outer casings 44 and 46. For example, as illustrated in FIG. 4, gap 56 may have a first thickness "$t_1$" adjacent first side 58 and a second thickness "$t_2$" adjacent second side 60, which may be disposed opposite first side 58. In one exemplary embodiment as illustrated in FIG. 4, first side 58 may be a lower side of suppressor 12 and second side 60 may be an upper side of suppressor 12. It should be noted, however, that the terms "lower" and "upper" as used in this disclosure should not be construed as representing positions relative to the ground. Rather the terms lower and upper merely represent relative positions along a vertical plane passing through longitudinal axis 34.

As also illustrated in FIG. 4, gap 56 may have a third thickness "$t_3$" adjacent third side 62 and a fourth thickness "$t_4$" adjacent fourth side 64, which may be disposed opposite third side 62. In one exemplary embodiment as illustrated in FIG. 4, third side 62 may be a left side of suppressor 12 and fourth side 64 may be a right side of suppressor 12. It should be noted that the terms "left" and "right" should not be construed as representing specific lateral positions but merely represent relative positions along a horizontal plane passing through longitudinal axis 34. Although four discrete thicknesses $t_1$, $t_2$, $t_3$, and $t_4$ have been illustrated in FIG. 4, it is contemplated that in some exemplary embodiments, a thickness of gap 56 may continuously vary around the periphery of inner and outer casings 44 and 46. It is also contemplated that in other exemplary embodiments a thickness of gap 56 may be uniform around the periphery of inner and outer casings 44 and 46.

Returning to FIG. 3, inner casing 44 may be attached to outer casing 46 by end wall 66, which may close off gap 56 adjacent proximal end 24. Inner casing 44 may also be attached to outer casing 46 by end wall 68, which may close off gap 56 adjacent distal end 26. In some exemplary embodiments, gap 56 may be evacuated so that end walls 66 and 68 may form a vacuum-sealed double walled casing, including inner and outer casings 44 and 46. It is also contemplated that in other exemplary embodiments that gap 56 may be filled with gas, sound dampening material, or insulation. Evacuating gap 56 in this manner may reduce acoustic vibration and/or heat transfer between inner casing 44 and outer casing 46, thereby minimizing an amount of sound and/or heat flow from combustion gases in hollow space 50 to outer surface 70 of outer casing 46. It is also contemplated that, in some exemplary embodiments, the use of vacuum-sealed double walled casing may allow for outer surface 70 to be potentially coated with a variety of substances, imparting acoustic dampening properties. Unlike prior-art suppressors that allow rapid transfer of heat to their outer surface, the vacuum-sealing of the disclosed exemplary embodiments may prevent baking off of the coating due to the heat transfer being stunted by vacuum As also illustrated in FIG. 3, end wall 66 may define opening 72 adjacent proximal end 24, and end wall 68 may define opening 74 adjacent distal end 26. Openings 72 and 74 may be concentrically disposed about longitudinal axis 34 of suppressor 12.

Body 30 may include one or more ports 76, which may pass through inner and outer casings 44 and 46 to connect hollow space 50 with the ambient. Walls 78 of ports 76 may help maintain a vacuum seal between inner and outer casings 44 and 46. Ports 76 may be distributed uniformly or non-uniformly over outer surface 70 of outer casing 46. Ports 76 may allow combustion gases to be vented to the ambient from hollow space 50 within body 30. As combustion gases escape from hollow space 50 through ports 76, the combustion gases may generate sound.

Heat shield 32 may extend from adjacent proximal end 24 to adjacent distal end 26. In one exemplary embodiment as illustrated in FIG. 4, heat shield 32 may be spaced apart from outer surface 70 of outer casing 46 by a gap 80. Heat shield 32 may be attached to outer surface 70 at spaced apart axial locations via legs 82. It is contemplated, however, that in some exemplary embodiments, heat shield 32 may be attached directly to outer surface 70 of outer casing 46 (i.e. without gap 80). In some exemplary embodiments, heat shield 32 may be a separate piece, which may be attached to outer casing 46. In other exemplary embodiments, heat shield 32 may be an integral part of outer casing 46. Heat shield 32 may cover some or all longitudinal and/or circumferential portions of outer surface 70. For example, as illustrated in FIG. 4, heat shield 32 may cover outer surface 70 of outer casing 46 adjacent upper side 60. Heat shield may also cover portions of left and right side surfaces 62 and 64 adjacent upper side 60. It is contemplated, however, that heat shield 32 may cover some or all portions of lower side 58, upper side 60, left side 62, and/or right side 64. As illustrated in FIG. 3, heat shield 32 may also cover portions of outer surface 70 adjacent opening 74. It is contemplated, however, that heat shield 32 may only cover portions of outer surface 70 disposed generally parallel to longitudinal axis 34.

Returning to FIG. 3, blast chamber portion 36 may include expansion chamber 84 disposed within body 30 of suppressor 12. Expansion chamber 84 may extend from adjacent proximal end 24 to expansion chamber end 86 disposed partway between proximal end 24 and distal end 26. Expansion chamber 84 may be partly defined by inner surface 48 of inner casing 44. Expansion chamber 84 may provide a large volume into which hot combustion gases entering suppressor 12 may expand, which in turn may decelerate and cool the combustion gases. In one exemplary embodiment, expansion chamber 84 may be an anechoic chamber 84 configured to muffle sound generated by the pressure waves within expansion chamber 84, by absorbing reflections of the pressure waves. Due to the characteristics of gas flow and boundary layers governed by the principles fluid dynamics, anechoic chamber 84 may also have the additional benefit of allowing gases to more fully fill the expansion chamber 84 similar to how dimples on a golf ball "suck" the gases near the ball's surface closer towards it (i.e. by disrupting the boundary layer). Anechoic chamber 84 may include structural features projecting inward from inner surface 48 toward longitudinal axis 34. For example, expansion chamber may include anechoic cones or pyramids, which may be in the form of conical structures 88 (e.g. wedges) projecting from inner surface 48 towards longitudinal axis 34. Conical structures 88 may have a relatively high aspect ratio. Thus, for example, a height of conical structure 88, measured generally perpendicular to inner surface 48 (and/or longitudinal axis 34) may be significantly larger than a width of conical structure 88 measured generally parallel to longitudinal axis 34. The high aspect ratio of conical structures 88 may cause the pressure waves to be reflected between the surfaces of conical structures 88 creating standing wave pattern, which may attenuate the pressure waves by allowing the energy of the pressure waves to be dissipated because of the viscosity of the air and gases disposed between the surfaces of conical structures 88. As discussed in this disclosure, the term "generally perpendicular" should be interpreted as encompassing perpendicularity within manufacturing tolerances. Thus, for example, two perpendicular objects or surfaces may be disposed at angles of 90°±1° relative to each other. Similarly, the term "generally parallel" should be interpreted as encompassing parallelism within manufacturing tolerances. Thus, for example, two objects or surfaces disposed parallel to each other may be disposed at angles of 0°±1° relative to each other.

Conical structures 88 may be disposed on some or all of a length of expansion chamber 84. Conical structures 88 may also be disposed over some or all of a periphery of inner casing 44. Thus, for example, conical structures 88 may project inwards from some or all portions of first, second, third, and fourth sides 58, 60, 62, and 64 of inner casing 44.

A first plurality of vanes 90 (first vanes 90) may be disposed in expansion chamber 84. First vanes 90 may project inwards from inner surface 48 of inner casing 44. In some embodiments, first vanes 90 may be disposed within hollow space 50 in expansion chamber 84 and may be connected to inner surface 48 and/or to conical structures 88 via one or more legs (not shown) projecting from inner surface 48. It is further contemplated that in some exemplary embodiments, only a portion of inner surface 48 of inner casing 44 may be covered with conical structures 88, and first vanes 90 may be attached to portions of inner surface 48 not covered with conical structures 88.

As a projectile (not shown) is propelled from proximal end 24 towards distal end 26 within suppressor 12, the combustion gases being ejected from the projectile may be expelled from the projectile. Leading end 92 of vane 90 may be disposed towards distal end 26 and trailing end 94 of vane 90 may be disposed towards proximal end 24.

In one exemplary embodiment as illustrated in FIG. 3, one or more of first vanes 90 may have an airfoil shape. The vanes 90 may impart friction to the gases passing through the suppressor 12 while also changing the vector of the gases as they progress through the suppressor, dissipating the energy of the gases and decelerating them. In the airfoil shape illustrated in FIG. 3, vanes 90 appear to be thicker adjacent leading end 92 as compared to adjacent trailing end 94. In this exemplary embodiment, the vanes 90 illustrated in the airfoil shape may have the additional advantage of creating a low pressure region as the gas flows through suppressor 12. The low pressure region resulting from the gases passing past vanes 90 illustrated as airfoils may impart drag to the gases, impeding their ability to rush through the suppressor 12. It is contemplated, however, that in some embodiments, vanes 90 may be thicker adjacent trailing end 94 as compared to adjacent leading end 92. Further, although first vanes 90 have been illustrated in FIG. 3 as having airfoil shapes, it is contemplated that vanes 90 may have any other shape (elliptical, triangular, circular, polygonal, etc.) known in the art. It is further contemplated that different vanes 90 may have different shapes, providing varying angles of attack for the flowing combustion gases, thereby imparting more extreme directional changes to the gases flowing through the suppressor 12. Additionally, vanes 90 may be porous or may have one or more holes to allow gases to pass through vanes 90, allowing gases flowing through the suppressor 12 to spread among the plurality of vanes 90.

Figure 5B:
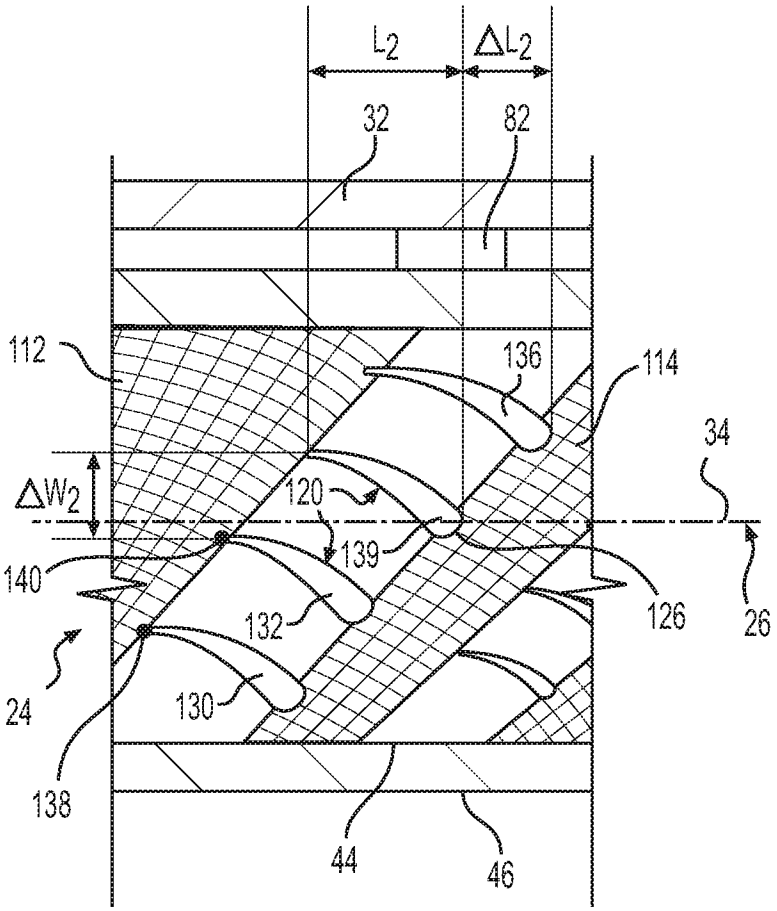
FIG. 5B is a magnified cross-sectional view of another portion of the suppressor of FIG. 2.
Figure 5A:
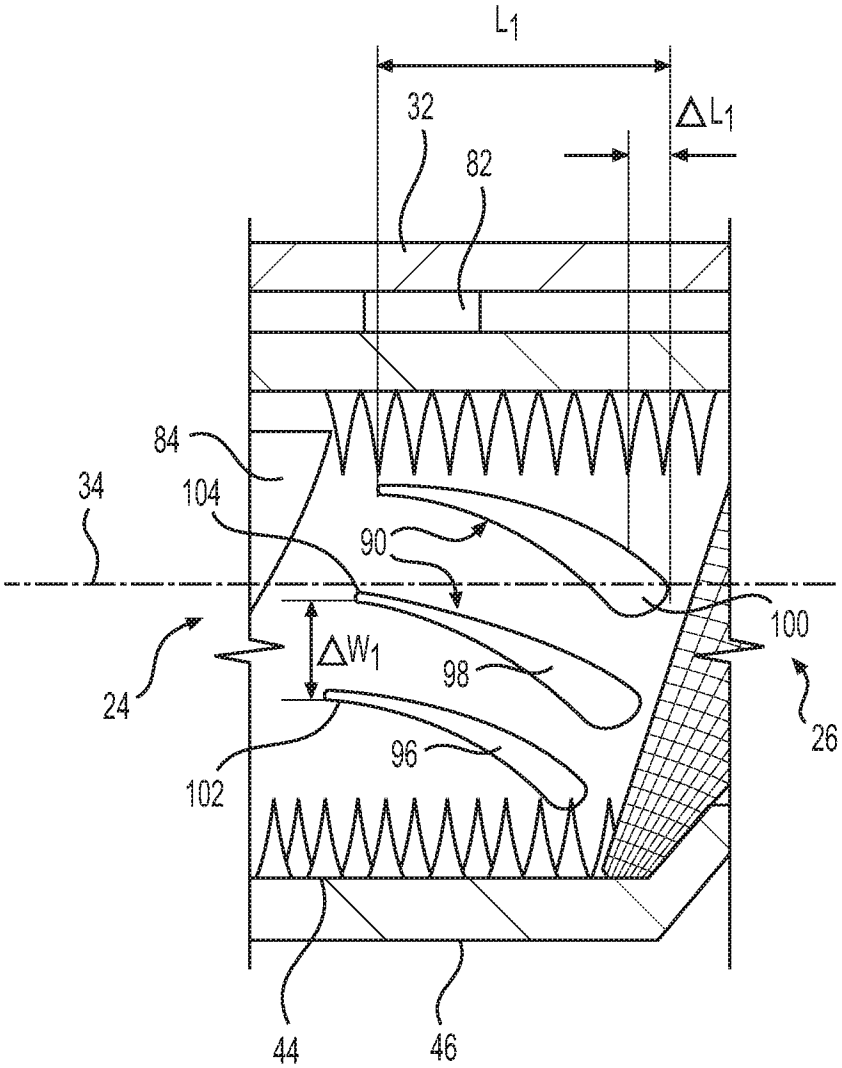
FIG. 5A is a magnified cross-sectional view of a portion of the suppressor of FIG. 2.

First vanes 90 may be spaced apart from each other along a periphery of inner casing 44. FIG. 5A illustrates a magnified cross-sectional view of first vanes 90 within expansion chamber 84. First vanes 90 may include vanes 96, 98, and 100. Although only three vanes 96, 98, and 100 are illustrated in FIG. 5A, it is contemplated that first vanes 90 may include one vane 90 or any number of vanes 90. Adjacent vanes 96 and 98, of first vanes 90, may be disposed at a lateral spacing "$\Delta W_1$" as determined in a plane disposed generally perpendicular to longitudinal axis 34. Lateral spacing $\Delta W_1$ may be uniform or non-uniform between successive pairs of vanes 90. Thus, for example, the lateral spacing between adjacent vanes 96 and 98 may be the same as or different from the lateral spacing between adjacent vanes 98 and 100. First vanes 90 may be generally inclined relative to longitudinal axis 34 and may be configured to impart a radial motion and/or a spinning motion (about longitudinal axis 34) to the combustion gases being ejected from the projectile. An angle of inclination of adjacent vanes 90 relative to longitudinal axis 34 may be uniform or non-uniform. Thus, for example, vanes 96, 98, and 100 may be inclined relative to longitudinal axis 34 at a same angle or at different angles.

First vanes 90 may have the same or different lengths "$L_1$." For example, lengths of vanes 96, 98, and 100 may be equal or unequal. As also illustrated in FIG. 5A, first vanes 90 may be axially offset from each other. Thus, for example, vanes 98 and 100 may be axially offset by a distance "$\Delta L_1$," determined generally parallel to longitudinal axis 34. It is also contemplated that the axial offset between adjacent first vanes 90 may be uniform or non-uniform. Thus, for example, an axial offset between vanes 96 and 98 may be the same as or different from an axial offset between vanes 98 and 100. It is also contemplated that in some exemplary embodiments, first vanes 90 may have no axial offset relative to each other (i.e. $\Delta L_1$ may be about 0). As used in this disclosure the term about should be interpreted as encompassing values including manufacturing tolerances. Thus, for example, $\Delta L_1$ of about 0 may encompass $\Delta L_1$ values of ±0.1 mm or ±0.1 inches, etc.

Although FIG. 5A illustrates vanes 96, 98, and 100 being disposed successively further from proximal end 24, it is contemplated that some or all vanes 96, 98, and 100 may instead be axially offset in an opposite direction (i.e. from distal end 26 towards proximal end 24). Thus, for example, trailing end 104 of vane 98 may be axially disposed toward proximal end 24 as compared to trailing end 102 of vane 96.

Returning to FIG. 3, gas decompression portion 38 may extend between expansion chamber 84 and distal end 26. Thus, for example, gas decompression portion 38 may extend from expansion chamber end 86 to adjacent distal end 26. Gas decompression portion 38 of hollow space 50 may include vane sections 106, 108, and 110, each including one or more vanes. Although only three vane sections 106, 108, and 110 are illustrated in FIG. 3, it is contemplated that gas decompression portion 38 may include any number of vane sections. In some exemplary embodiments, mesh structures may be disposed between some or all vane sections 106, 108, and 110. For example, as illustrated in FIG. 3, vane section 106 may be axially separated from first vanes 90. Mesh structure 112 may be disposed between first vanes 90 and vane section 106. Vane section 108 may be axially separated from vane section 106. Mesh structure 114 may be disposed between vane sections 106 and 108. Vane section 110 may be axially separated from vane section 108. Mesh structure 116 may be disposed between vane sections 108 and 110. Mesh structure 118 may be disposed between vane section 110 and distal end 26. Although mesh structures 112, 114, 116, and 118 are illustrated in FIG. 3, it is contemplated that in some embodiments, suppressor 12 may not include one or more of mesh structure 112, 114, 116, and 118.

Vane section 106 may include second plurality of vanes 120 (second vanes 120), vane section 110 may include third plurality of vanes 122 (third vanes 122), and vane section 110 may include fourth plurality of vanes 124 (fourth vanes 124). Second vanes 120 may be disposed between first vanes 90 and distal end 26. Second vanes 120 may project inwards from inner surface 48 of inner casing 44. It is also contemplated that second vanes 120 may be disposed within hollow space 50 in vane section 106 and may be connected to inner surface 48 via one or more legs (not shown) projecting from inner surface 48. In one exemplary embodiment as illustrated in FIG. 3, one or more of second vanes 120 may have an airfoil shape. In the airfoil shape illustrated in FIG. 3, vanes 120 appear to be thicker adjacent leading end 126 as compared to adjacent trailing end 128. It is contemplated, however, that in some embodiments, vanes 120 may be thicker adjacent trailing end 128 as compared to adjacent leading end 126. Further, although second vanes 120 have been illustrated in FIG. 3 as having airfoil shapes, it is contemplated that vanes 120 may have any other shape (elliptical, triangular, circular, polygonal, etc.) known in the art. It is also contemplated that different vanes 120 may have different shapes.

Second vanes 120 may be spaced apart from each other along a periphery of inner casing 44. FIG. 5B illustrates a magnified cross-sectional view of second vanes 120 within vane section 106. Second vanes 120 may include vanes 130, 132, 134, and 136. Although only four vanes 130, 132, 134, and 136 are illustrated in FIG. 5B, it is contemplated that second vanes 120 may include any number of vanes 120. Adjacent vanes 132 and 134, of second vanes 120, may be disposed at a lateral spacing "$\Delta W_2$" as determined in a plane disposed generally perpendicular to longitudinal axis 34. The lateral spacing $\Delta W_2$ may be uniform or non-uniform between successive pairs of vanes 120. Thus, for example, the lateral spacing between adjacent vanes 130 and 132 may be the same as or different from the lateral spacing between adjacent vanes 132 and 134. Second vanes 120 may be generally inclined relative to longitudinal axis 34 and may be configured to impart a radial motion and/or a spinning motion (about longitudinal axis 34) to the combustion gases being ejected from the projectile. An angle of inclination of second vanes 120 relative to longitudinal axis 34 may be uniform or non-uniform. Thus, for example, vanes 130, 132, 134, and 136 may be inclined relative to longitudinal axis 34 at a same angle or at different angles.

Second vanes 120 may have the same or different lengths "$L_2$." For example, lengths of vanes 130, 132, 134, and 136 may be equal or unequal. As also illustrated in FIG. 5B, second vanes 120 may be axially offset from each other. Thus, for example, vanes 134 and 136 may be axially offset by a distance "$\Delta L_2$," determined generally parallel to longitudinal axis 34. It is also contemplated that the axial offset between adjacent second vanes 120 may be uniform or non-uniform. Thus, for example, an axial offset between vanes 130 and 132 may be the same as or different from an axial offset between vanes 132 and 134. It is also contemplated that second vanes 120 may have no axial offset relative to each other (i.e. $\Delta L_2$ may be about 0). Although FIG. 5B illustrates vanes 130, 132, 134, and 136 being successively disposed further from proximal end 24, it is contemplated that some or all vanes 130, 132, 134, and 136 may instead be axially offset in an opposite direction from distal end 26 towards proximal end 24. Thus, for example, in some exemplary embodiments, trailing end 140 of vane 132 may be axially disposed toward proximal end 24 as compared to trailing end 138 of vane 130.

Returning to FIG. 3, third vanes 122 may be disposed between second vanes 120 and distal end 26, and fourth vanes 124 may be disposed between third vanes 122 and distal end 26. Third and fourth vanes 122 and 124 of vane sections 108 and 110 may have structural arrangements similar to those described above for first vanes 90 or second vanes 120. The lengths of first, second, third, and fourth vanes, 90, 120, 122, and 124 may be equal or unequal. For example, as illustrated in the exemplary embodiment of FIG. 3, lengths of vanes in first vanes 90 and vane sections 106, 108, and 110 may successively decrease in a direction from proximal end 24 to distal end 26. It is contemplated however that first, second, third, and fourth vanes 90, 120, 122, and 124 may have any lengths. Further the lengths of first, second, third, and fourth vanes 90, 120, 122, and 124 may or may not continuously increase or decrease in a direction from proximal end 24 towards distal end 26. The lateral spacings (e.g. $\Delta W_1$, $\Delta W_2$, etc.) of the first, second, third, and fourth vanes 90, 120, 122, and 124 may be equal or unequal. Likewise, axial offsets (e.g. $\Delta L_1$, $\Delta L_2$, etc.) of the first, second, third, and fourth vanes 90, 120, 122, and 124 may also be equal or unequal.

First, second, third, and fourth vanes, 90, 120, 122, and 124 may have the same or different angles of inclination relative to longitudinal axis 34. As described above, individual vanes within first, second, third, and fourth vanes, 90, 120, 122, and 124 may also have equal or unequal angles of inclination relative to longitudinal axis 34. A number of vanes in first, second, third, and fourth vanes, 90, 120, 122, and 124 may be $n_1$, $n_2$, $n_3$, and $n_4$, respectively. In one exemplary embodiment as illustrated in FIG. 3, $n_1<n_2<n_3<n_4$. However, this relationship is exemplary and it is contemplated that the number of vanes $n_1$, $n_2$, $n_3$, and $n_4$ may be equal or unequal, and may or may not successively increase or decrease in a direction from proximal end 24 to distal end 26.

First, second, third, and fourth vanes, 90, 120, 122, and 124 may have tips 142, 144, 146, and 148, respectively. Tips 142, 144, 146, and 148 may be laterally spaced apart from longitudinal axis 34 and may define a generally cylindrical bore or passageway 150 (FIG. 4). Passageway 150 may be concentric with muzzle 22 of firearm 10 and with openings 72 and 74 in body 30, allowing a projectile to travel through opening 72, passageway 150, and opening 74 of suppressor 12, when firearm 10 is discharged.

As discussed above, and as illustrated in FIG. 3, one or more of mesh structures 112, 114, 116, and/or 118 may be disposed between first, second, third, and fourth vanes, 90, 120, 122, and 124, respectively. Mesh structures 112, 114, 116, and/or 118 may be attached to inner surface 48 of inner casing 44. Mesh structures 112, 114, 116, and/or 118 may also include openings disposed concentrically around longitudinal axis 34 to allow the projectile to pass through mesh structures 112, 114, 116, and/or 118. Mesh structures 112, 114, 116, and/or 118 may be configured to reflect, deflect, and/or slow down the combustion gases expelled from the projectile travelling through passageway 150. Furthermore, the mesh structures 112, 114, 116, and or 118 may provide additional structural integrity to suppressor 12 and may help inhibit vibrations which translate to sound. Additionally, the mesh structures 112, 114, 116, and or 118 may slow the combustion gases due to friction while limiting the blowback effect experienced by prior art suppressors using baffles and expansion chambers by alleviating the backpressure. Traditional baffles in prior-art suppressors merely allow combustion gases to slam into the baffles in a short amount of time. In contrast, the disclosed exemplary mesh structures 112, 114, 116, and/or 118 may advantageously allow gases to flow through them, allowing for a reduction in gas velocity over a longer time period (i.e. as the combustion gases pass through the structure). It is further contemplated that the mesh structures 112, 114, 116, and or 118 may be configured to change the direction of the combustion gases as they flow through said structure, creating a longer distance for said gases to travel before exiting the suppressor 12. It is also contemplated that in some exemplary embodiments, one or more mesh structures 112, 114, 116, or 118 may be disposed between the one or more vanes 90, 120, 122, and/or 124 instead of or in addition to being disposed between the one or more vane sections 106, 108, and/or 110. It is further contemplated that, in some exemplary embodiments, distal end 26 may comprise of mesh structure 118. Thus, in these exemplary embodiments, distal end 26 may be porous and may allow slower escaping gases to more easily exit the suppressor 12 and lower backpressure, thereby limiting the blowback effect discussed above.

Figure 6:
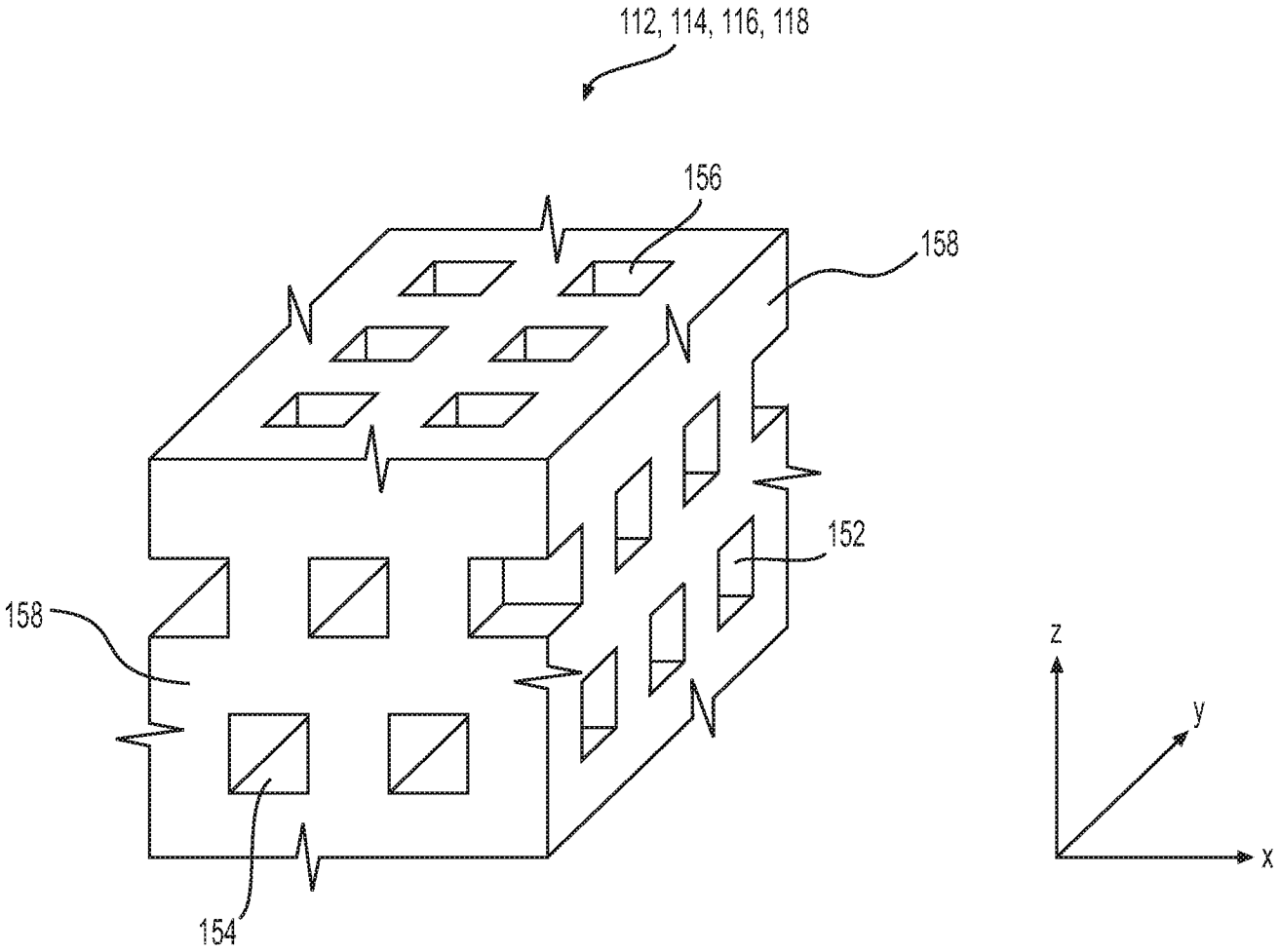
FIG. 6 is a magnified view of a portion of a mesh structure of the suppressor of FIG. 2.

FIG. 6 illustrates an exemplary portion of mesh structure 112. As illustrated in the exemplary embodiment of FIG. 6, mesh structure 112 may include a lattice structure including, for example, one or more pores 152, 154, and 156 separated by solid portions 158. The sizes of pores 152, 154, and 156 may be equal or unequal. Further, although pore sizes of pores 152, 154, or 156 appear to be uniform along directions x, y, and z, respectively, it is contemplated that adjacent pores along directions x, y, or z may have the same size or different sizes. Additionally, although pores 152, 154, and 156 in FIG. 6 appear to have generally rectangular shapes, it is contemplated that pores 152, 154, and 156 may have a circular, elliptical, triangular, rhomboidal, polygonal, or any other shapes known in the art. The arrangement of pores 152, 154, and 156, and the intervening solid portions 158 in FIG. 6 is exemplary and other arrangements are also contemplated. Pores 152, 154, and 156, and the intervening solid portions 158 may provide a mesh like structure, which may decelerate and/or cool combustion gases passing through pores 152, 154, and 156. Mesh structures 114, 116, and 118 may have a structure similar to that of mesh structure 112.

Returning to FIG. 3, mesh structures 112, 114, 116, and 118 may have successively finer pores 152, 154, and 156. Thus, for example, mesh structure 114 may have pores 152, 154, or 156 of a smaller size than pores 152, 154, or 156 of mesh structure 112. Likewise, mesh structure 116 may have pores 152, 154, or 156 of a smaller size than pores 152, 154, or 156 of mesh structure 114. However, this arrangement is exemplary and it is contemplated that pores 152, 154, and 156 of mesh structures 112, 114, 116, 118 may have any sizes. It is also contemplated that a porosity of mesh structures 112, 114, 116, 118 may continuously increase, decrease, or be selected to vary in a direction from proximal end 24 to distal end 26 of suppressor 12. For example, the porosity of mesh structures 112, 114, 116, and 118 may be selected to minimize an amount of sound generated by the combustion gases as they traverse suppressor 12. As used in this disclosure, porosity of mesh structures 112, 114, 116, and 118 may be defined as a ratio of a total volume of pores 152, 154, and 156 and a total volume of a respective mesh structure. Although particular internal structures, for example, conical structures 88, first, second, third, and fourth vanes 90, 120, 122, and 124, and mesh structures 112, 114, 116, and 118 have been discussed above, many other types of internal structures, for example, fins, projections, baffles, orifices, sieves, contoured surfaces, etc. may be arranged within hollow space 50 to muffle and/or reduce the sound of a discharging firearm using suppressor 12.

Attachment portion 28 of suppressor 12 may include muzzle brake 160. Muzzle brake 160 may be attached to suppressor 12 and to muzzle 22 of firearm 10. Muzzle brake 160 may include connector 162 and notch 164. Connector 162 may allow muzzle brake 160 to be attached to muzzle 22 of firearm 10. In one exemplary embodiment as illustrated in FIG. 3, connector 162 may include threads that may mate with corresponding threads on or in muzzle 22, allowing muzzle brake 160 to be screwed into or on to muzzle 22. It is contemplated, however, that connector 162 may take the form of clips, quick-disconnect clamps, or other methods of attachment known in the art. It is further contemplated that in other exemplary embodiments, muzzle brake 160 may be substituted for a flash suppressor (not shown) or other non-suppressor muzzle device, compensator, barrel lugs, or ridges, or a combination (i.e. hybrid) of one or more such devices. It is also contemplated that in some exemplary embodiments, muzzle device (e.g. muzzle brake 160) may be integrally formed with suppressor 12 and may function as a blast baffle. In other exemplary embodiments, muzzle device (e.g. muzzle brake 160) may be separate and detachable from suppressor 12.

In some embodiments, muzzle brake 160 may include notch 164. Inner casing 44 of suppressor 12 may include projection 166, which may project inwards from inner surface 48 of inner casing 44 towards longitudinal axis 34. Projection 166 may be insertable into notch 164 to detachably attach suppressor 12 to muzzle brake 160, and therefore to muzzle 22 of firearm 10.

Figure 7:
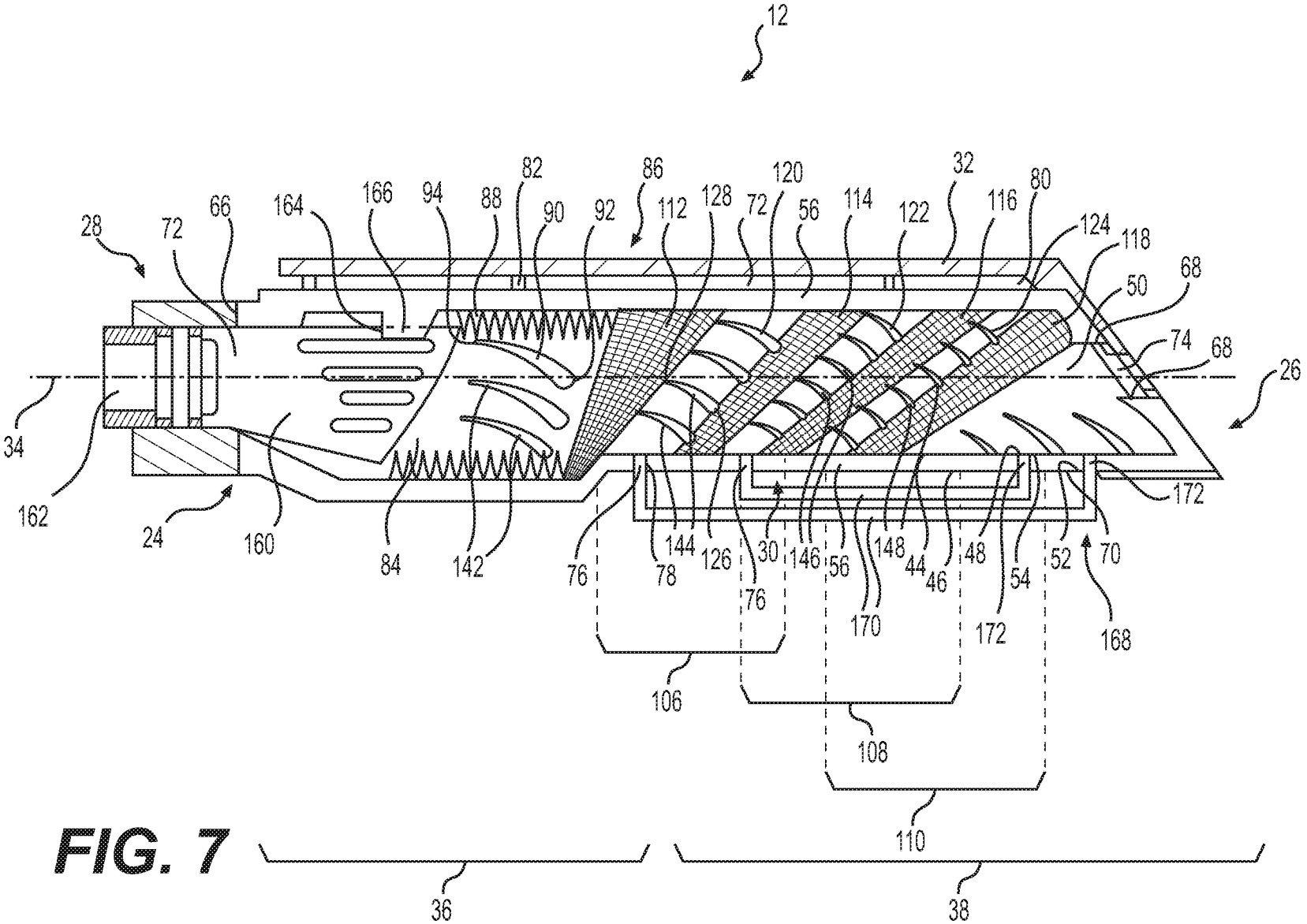
FIG. 7 is a cross-sectional view of another exemplary disclosed suppressor.

FIG. 7 illustrates a cross-sectional view of another exemplary embodiment of suppressor 12 in a plane passing through longitudinal axis 34. Suppressor 12 illustrated in FIG. 7 includes many of the features illustrated in FIG. 3 and discussed above. Therefore, only features of suppressor 12 of FIG. 7 that differ from the embodiment of FIG. 3 will be discussed below.

As illustrated in FIG. 7, suppressor 12 may include recirculator 168, which may include one or more passageways 170. Passageways 170 may connect one or more outlet ports 172 disposed nearer distal end 26 of suppressor 12 to ports 76, which may serve as inlet ports. Exhaust gases may enter the one or more passageways via the one or more outlet ports 172, may recirculate, and may reenter suppressor 12 via one or more inlet ports 76. Recirculating the gases in this manner may deplete the energy and velocity of the gases helping to further suppress the report of generated by a projectile travelling through suppressor 12. The one or more passageways 170 may have the effect of emulating a longer suppressor 12. Sizes and positions of outlet ports 172 and inlet ports 76 may be selected to reduce the speed of the combustion gases such that the sound generated by venting of gases from hollow space 50 via ports outlet ports 172 may occur at frequencies that may be near or above a threshold frequency for human hearing (i.e. frequency above which humans cannot hear the sound).

Figure 8:
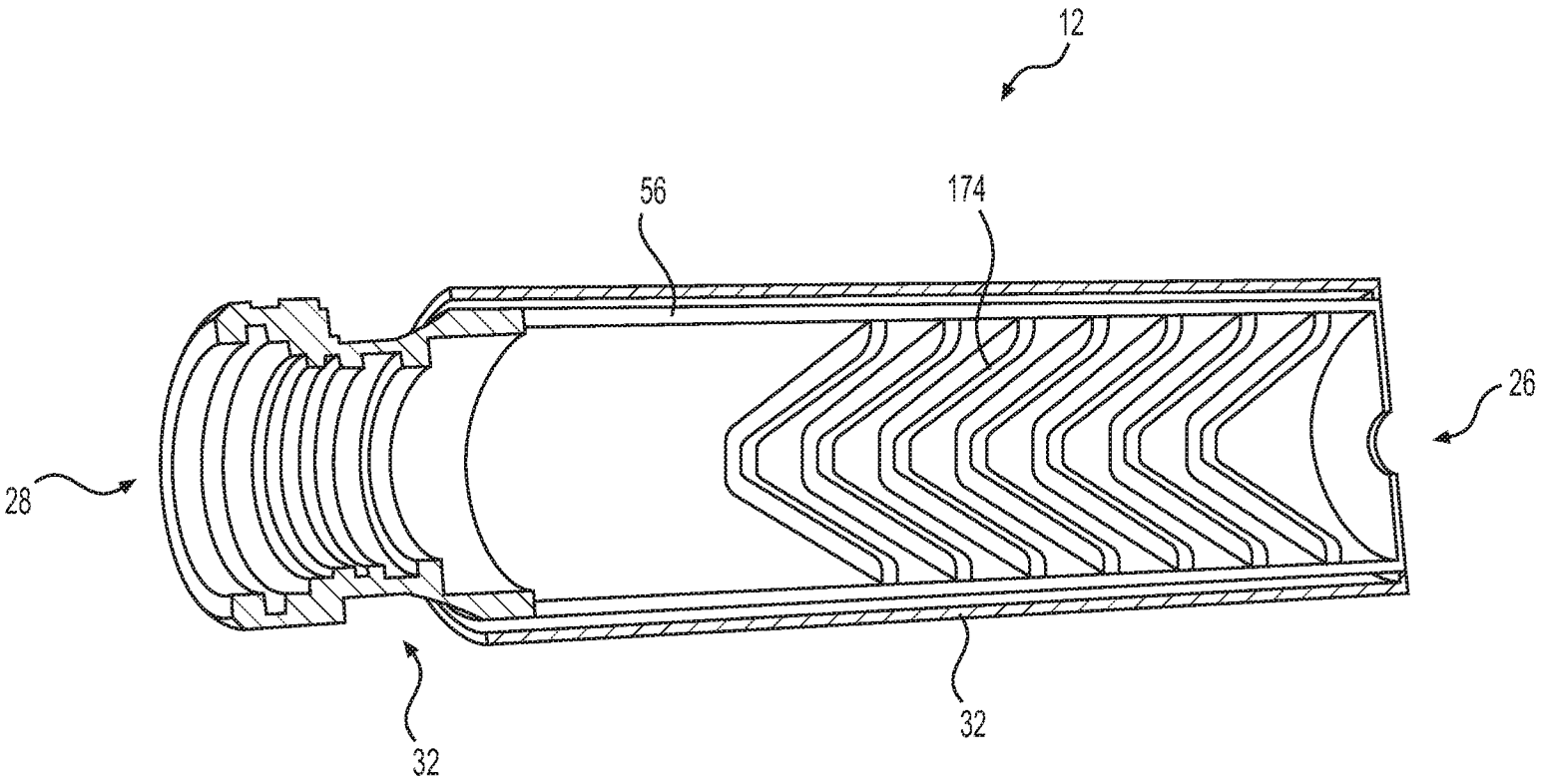
FIG. 8 is a cross-sectional view of yet another exemplary disclosed suppressor.

A variety of features, for example, heat shield 32, a double-walled body having an inner casing 44 and an outer casing 46 separated by an evacuated or filled gap 56, anechoic chamber 78, one or more vane sections 106, 108, 110, one or more mesh structures 112, 114, 116, and recirculator 168, etc. have been discussed above in connection with exemplary embodiments of suppressor 12. As illustrated in FIG. 8, it is contemplated however, that some exemplary embodiments of suppressor 12 may include baffles 174 disposed within body 30. As also illustrated in FIG. 8, in some exemplary embodiments, suppressor 12 with baffles 174 may further include one or more of gap 56 and/or heat shield 32. Although not explicitly illustrated in FIG. 7, it is further contemplated that suppressor 12 with baffles 174 may additionally or alternatively include one or more of a double-walled body having an inner casing 44 and an outer casing 46 separated by an evacuated or filled gap 56, anechoic chamber 78, one or more vane sections 106, 108, 110, one or more mesh structures 112, 114, 116, and/or recirculator 168, etc.

Figure 9:
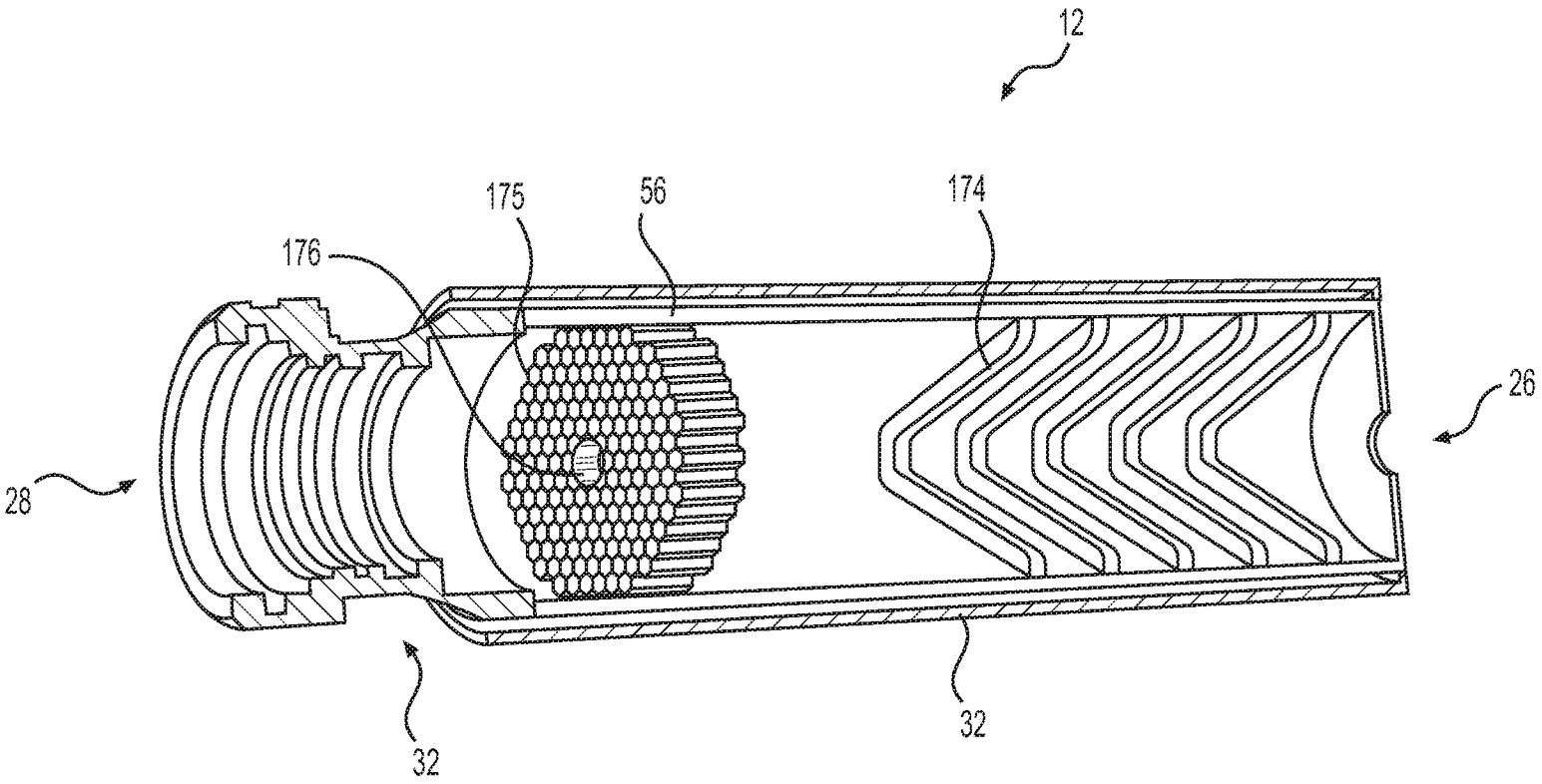
FIG. 9 is a cross-sectional view of yet another exemplary disclosed suppressor including porous vectored baffles.

FIG. 9 illustrates a cross-section of suppressor 12 in which some or all of vanes 90 and vane sections 106, 108, 110 may be replaced with one or more porous vectored baffles 175. As discussed above each of vane sections 106, 108, 110 may include vanes 120, 122, and 124 separated by one or more mesh sections 112, 114, 118. In some exemplary embodiments, instead of including one or more mesh sections 112, 114, 118 between vanes 120, 122, 124, vanes 90, 112, 122, 124 may be replaced with one or more porous vectored baffles 175.

Porous vectored baffle 175 may alter the trajectory of the combustion gases while also diffusing the blast of a gunshot and sapping those gases of energy within the suppressor. Porous vectored baffles 175 may contain bore hole 176 to allow a projectile (not shown) to pass through it. Porous vectored baffles 175 may angle the combustion gases in any direction away from the axis of the projectile's pathway. Additionally, it is contemplated that porous vectored baffle 175 may comprise of one or more conduits bound together (appearing similar to a bundle of straws) allowing combustion gases to flow through porous vectored baffle 175. Furthermore, in one exemplary embodiment, the conduits within porous vectored baffle 175 may be approximately honeycomb or hexagonal shape. It is contemplated, however, that a cross-section of porous vectored baffle 175 may take any shape such as a circular, rectangular, octagonal or comparable shape. It is additionally contemplated that the porous vectored baffles 175 may divert combustion gases at angles exceeding about 45° relative to longitudinal axis 34. In some exemplary embodiments, porous vectored baffle 175 may be used as a blast baffle within suppresser 12 to calm the initial explosive, abrasive combustion gases rushing from attachment portion 28. It is further contemplated that in some exemplary embodiments, porous vectored baffles 175 may be located only in a portion of a cross-sectional area of suppressor 12.

INDUSTRIAL APPLICABILITY

The disclosed suppressor may be used to reduce the sound generated during discharge of a firearm. The disclosed suppressor may include a novel architecture including specialized internal structures, such as, anechoic cones, vanes, and/or mesh structures that may be arranged to allow the combustion gases from a projectile to expand, decelerate, and cool down, minimizing the sound generated by discharge of the firearm. The novel architecture of the disclosed suppressor may also include a double-walled, vacuum-sealed suppressor casing that may further help muffle the noise and prevent heat of the combustion gases from reaching outer surfaces of the suppressor. By insulating the outer casing of the suppressor, using the vacuum-sealed gap, the disclosed suppressor may allow for ease of handling of the suppressor during assembly or disassembly from a firearm.

The disclosed suppressor architecture, including a double walled casing, anechoic cones (or wedges), vanes, and/or mesh structures may be manufactured using additive manufacturing techniques, which may produce a unitary monolithic suppressor without any seams or joints. One such additive manufacturing method is disclosed in detail in U.S. patent application Ser. No. 15/423,800 filed on Feb. 3, 2017, the contents of which are incorporated herein by reference in their entirety.

One exemplary additive manufacturing method may include separating suppressor 12 into a plurality of thin sections generally perpendicular to axis 34. The method may further include depositing a layer of powdered material and directing an energy beam on to the layer in a pattern corresponding to each of the thin sections. The steps of depositing the powdered material and directing the energy beam may be carried out sequentially to create successive sections on top of each other so as to yield a unitary monolithic structure of suppressor 12. Because the powdered material used in such additive manufacturing methods may be highly flammable, the additive manufacturing method may be performed in equipment from which air may be evacuated to minimize and/or eliminate the risk of fire.

In one exemplary embodiment, the additive manufacturing method may include sequentially generating sections of inner casing 44 and outer casing 46 to create a double-walled body 30 of suppressor 12. Because the energy beam may be directed to form inner casing 44 and outer casing 46, powdered material may remain in gap 56 between inner casing 44 and outer casing 46. The method may, therefore, include removing suppressor 12 with the double-walled body from the additive manufacturing equipment and removing powdered material remaining in gap 56 between inner casing 44 and outer casing 46. The method may further include positioning the thus cleaned suppressor 12 in the additive manufacturing equipment, reducing an atmospheric pressure within the equipment to generate vacuum like conditions, applying powdered material only adjacent open ends of inner casing 44 and outer casing 46, and directing the energy beam to sinter the powdered material to seal gap 56 between inner casing 44 and outer casing 46. Sealing gap 56 in the evacuated additive manufacturing equipment in this manner may help produce a unitary monolithic suppressor 12 having an evacuated double-walled body 30. It is contemplated that alternative methods of removing the powdered material, evacuating gap 56 and sealing open ends of inner casing 44 and outer casing 46 may also be used to produce a unitary monolithic suppressor 12 having an evacuated double-walled body 30. For example, after removing powdered material from gap 56, open ends of inner casing 44 and outer casing 46 may be closed via welding or brazing. Gap 56 may be evacuated via an opening in the welded ends and the opening my subsequently be sealed to produce suppressor 12 suppressor 12 having an evacuated double-walled body 30.

It should be noted that conventional manufacturing methods such as casting or machining may be incapable of providing the disclosed specialized internal structures. For example, to manufacture the disclosed double walled casing, anechoic cones (or wedges), vanes, and/or mesh structures using conventional casting or machining techniques, it may be necessary to split the disclosed suppressor into two or more sections. The separate sections may then need to be joined, using welding, brazing, or other adhesive processes. The pressures and temperatures generated in the suppressor, when a projectile traverses the suppressor, however, may induce stresses in the welding or brazing joints of the separate sections. These stresses may be large enough to damage and/or destroy the joints rendering the suppressor manufactured using conventional casting or machining techniques ineffective. In contrast, the use of additive manufacturing techniques may yield a unitary monolithic suppressor, including the disclosed novel and complex internal structures (e.g. double walled casing, anechoic cones or wedges, vanes, and/or mesh structures). The disclosed novel and complex internal features of the disclosed suppressor may also be more effective in reducing the sound produced by the discharge of a firearm than conventional suppressors typically manufactured using conventional casting or machining techniques.

It will be apparent to those skilled in the art that various modifications and variations can be made to the disclosed suppressor. Other embodiments will be apparent to those skilled in the art from consideration of the specification and practice of the disclosed suppressor. It is intended that the specification and examples be considered as exemplary only, with a true scope being indicated by the following claims and their equivalents.

What is claimed is:

1. A suppressor for a firearm, comprising:

a hollow elongated body extending from a proximal end to a distal end;

an expansion chamber disposed within the body, the expansion chamber extending from adjacent the proximal end to a position between the proximal and distal ends;

a first plurality of vanes disposed in the expansion chamber, the first vanes being laterally spaced apart from each other along a periphery of the body; and a second plurality of vanes disposed in the body, the second vanes being axially spaced apart from the first vanes, wherein the first plurality of vanes are axially offset from each other.

2. The suppressor of claim 1, wherein the body has a generally cylindrical shape.

3. The suppressor of claim 1, wherein the body further includes:

an outer casing extending from adjacent the proximal end to adjacent the distal end; and an inner casing disposed within the outer casing, the inner casing extending from adjacent the proximal end to the distal end.

4. The suppressor of claim 3, further including openings in the inner and outer casings adjacent the proximal and distal ends, wherein the cylindrical passageway is concentric with the openings.

5. The suppressor of claim 3, wherein the inner casing and the outer casing are separated by a gap.

6. The suppressor of claim 3, further including a heat shield disposed on at least a portion of the outer casing.

7. The suppressor of claim 1, wherein the expansion chamber is an anechoic chamber.

8. The suppressor of claim 7, wherein the anechoic chamber includes a plurality of conical structures extending inwards from the body into the anechoic chamber.

9. The suppressor of claim 1, wherein at least one of the first vanes has an airfoil shape.

10. The suppressor of claim 1, wherein the second plurality of vanes are laterally and axially offset from each other.

11. The suppressor of claim 1, wherein a first number of the first vanes is different from a second number of the second vanes.

12. The suppressor of claim 11, wherein the first number is smaller than the second number.

13. The suppressor of claim 1, further including a mesh structure disposed between the first vanes and the second vanes, the mesh structure extending inwards from the body.

14. The suppressor of claim 1, further including a third plurality of vanes disposed between the second plurality of vanes and the distal end.

15. The suppressor of claim 14, further including:

a first mesh structure disposed between the first vanes and the second vanes; and a second mesh structure disposed between the second vanes and the third vanes.

16. The suppressor of claim 15, wherein the first mesh structure has a first pore size, and the second mesh structure has a second pore size different from the first pore size.

17. The suppressor of claim 16, wherein the first pore size is larger than the second pore size.

18. The suppressor of claim 1, wherein the first vanes are generally inclined at a first angle relative to a longitudinal axis of the suppressor, and the second vanes are generally inclined at a second angle, different from the first angle, relative to the longitudinal axis.

* * * * *